US007321308B1

(12) United States Patent
Feibelman

(10) Patent No.: US 7,321,308 B1
(45) Date of Patent: Jan. 22, 2008

(54) ANTI-THEFT HOLDER

(75) Inventor: Jeffrey A Feibelman, Providence, RI (US)

(73) Assignee: Display Technologies, Inc., Johnston, RI (US)

( * ) Notice: Subject to any disclaimer, the term of this patent is extended or adjusted under 35 U.S.C. 154(b) by 147 days.

(21) Appl. No.: 11/217,992

(22) Filed: Sep. 1, 2005

(51) Int. Cl.
*G08B 13/14* (2006.01)

(52) U.S. Cl. ..... 340/572.8; 340/571

(58) Field of Classification Search ..... 340/572.8, 340/572.9, 571; 235/487–495; 40/299.01, 40/124.01

See application file for complete search history.

(56) References Cited

U.S. PATENT DOCUMENTS

| | | | | |
|---|---|---|---|---|
| 4,673,932 | A | 6/1987 | Ekchian et al. | 340/825.54 |
| 4,861,260 | A * | 8/1989 | Bartley et al. | 425/529 |
| 4,862,160 | A | 8/1989 | Ekchian et al. | 340/825.54 |
| 5,174,440 | A | 12/1992 | Chiu | 206/38 |
| 5,884,425 | A | 3/1999 | Baldwin | 40/638 |
| 5,982,282 | A | 11/1999 | Ryan, Jr. | 340/572.1 |
| 5,982,284 | A | 11/1999 | Baldwin et al. | 340/572.8 |
| 6,199,309 | B1 | 3/2001 | Markarian | 40/299.01 |
| 6,271,753 | B1 | 8/2001 | Shukla | 340/545.6 |
| 6,313,747 | B2 | 11/2001 | Imaichi et al. | 340/572.5 |
| 6,326,890 | B1 | 12/2001 | Costa | 340/572.9 |
| 6,592,034 | B1 | 7/2003 | Millard et al. | 235/449 |
| 6,724,311 | B1 | 4/2004 | Kolton et al. | 340/572.8 |
| 6,943,689 | B2 * | 9/2005 | Kolton et al. | 340/572.8 |
| 2003/0043039 | A1 | 3/2003 | Salemi et al. | 340/572.8 |

* cited by examiner

*Primary Examiner*—Jeffery Hofsass
*Assistant Examiner*—Hongmin Fan
(74) *Attorney, Agent, or Firm*—Bainwood Huang

(57) ABSTRACT

An anti-theft security holder for cylindrical articles includes a support member, and EAS marker and an outer sleeve is disclosed. The support member is preferably shaped to receive the cylindrical item in a seated position and the EAS marker may be supported within the support member such that is sandwiched between the support member and the cylindrical article during use. An outer sleeve, for example a plastic shrink-wrapped sleeve, may be used to secure the support member to the cylindrical article. In one embodiment, the side walls are rigid and are supported at an angle such that a gap is formed between a portion of the article and the base so that the EAS member fits with the gap.

25 Claims, 6 Drawing Sheets

ANTI-THEFT HOLDER

TECHNICAL FIELD

The invention relates generally to an anti-theft tag and, more specifically, to an anti-theft holder including an electronic article sensor and a housing for supporting articles with cylindrical surfaces.

BACKGROUND

Surveillance systems which are used to deter theft of merchandise from retail stores are well known in the art. For example, systems utilizing electronic article surveillance (EAS) markers or tags which activate an alarm upon removal of the article from the store are frequently utilized by retail stores. These types of markers are typically secured to an article and are either removed or rendered inactive at checkout. In some cases the markers are visible to customers, and in other cases the markers are hidden from view in order to prevent unauthorized removal. In either case, if the markers are not rendered inactive or removed, they will be sensed by the EAS system causing an alarm to sound, usually when exiting the retail store. The use of EAS markers or tags to trigger an alarm has been somewhat successful in deterring the theft of merchandise. However, the use of EAS tags with certain types of merchandise has not always been successful due to the nature of the merchandise. For example, some articles of merchandise are inherently difficult to tag, either due to their size or shape, or a combination of the two. In such cases, the EAS marker may simply be stuck to the article or the marker may be hidden in a display box, such as with articles of jewelry and watches. While sticking the marker to the article can deter some theft, such markers are often simply removed and the item stolen. In addition, for lower cost items, such as cosmetics, the use of a display box is often cost prohibitive. However, such small, low cost consumer items that are difficult to tag are often the target of shoplifters.

While generally effective, the aforementioned devices and others available in the art can still be difficult to attach to certain products due to their size and/or shape. Accordingly, there is continued development in the art in order to further improve anti-theft theft tags for such articles.

SUMMARY

In accordance with the present invention, there is provided an anti-theft security holder for articles having a variety of shapes, including cylindrical, the holder having a support member including a base and a pair of upstanding side walls, and an EAS marker supported thereon. In one embodiment, the support member is preferably shaped to receive a cylindrical item in a seated position and the EAS marker may be supported within the support member such that is sandwiched between the support member and the cylindrical article during use. In one embodiment, the side walls are substantially rigid and are supported at an angle such that a gap is formed between a portion of the article and the base so that the EAS member fits with the gap. In another embodiment, the side walls have a stepped configuration. An outer sleeve, for example a plastic shrink-wrapped sleeve, may be used to secure the support member to the cylindrical article. The anti-theft security holder disclosed herein is cost effective, can be readily assembled and is tamper resistant after assembly, as described in greater detail herein below.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENT

An anti-theft security holder 10 for supporting an electronic article surveillance (EAS) marker 12 and a cylindrical article, such as a lipstick or other article is illustrated in FIGS. 1-5. As used herein, the term "article" refers to any type or style of consumer product. Also as used herein, the term "cylindrical" is used in a conventional manner and includes articles which are only partially cylindrical, for example cylindrical at one end or on one side. In the following description the cylindrical article is shown and described as lipstick. However, it is expressly understood that the present invention is not limited to use with lipstick or cosmetics, and may be used with any of a variety of articles as would be known to those of skill in the art.

Figure 1:
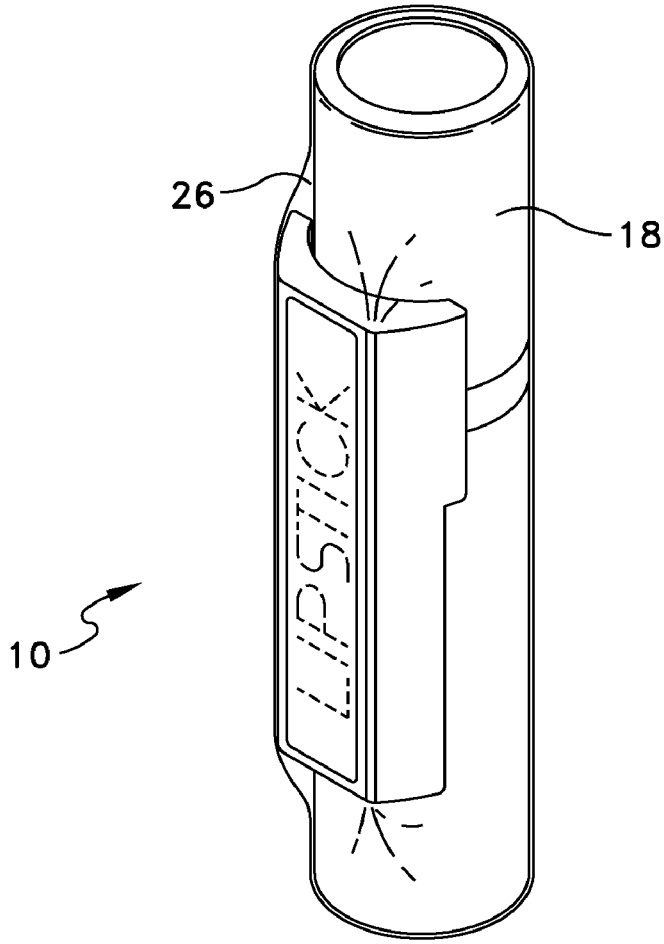
FIG. 1 is a perspective view of an anti-theft holder for a cylindrical article according to one embodiment.
Figure 2:
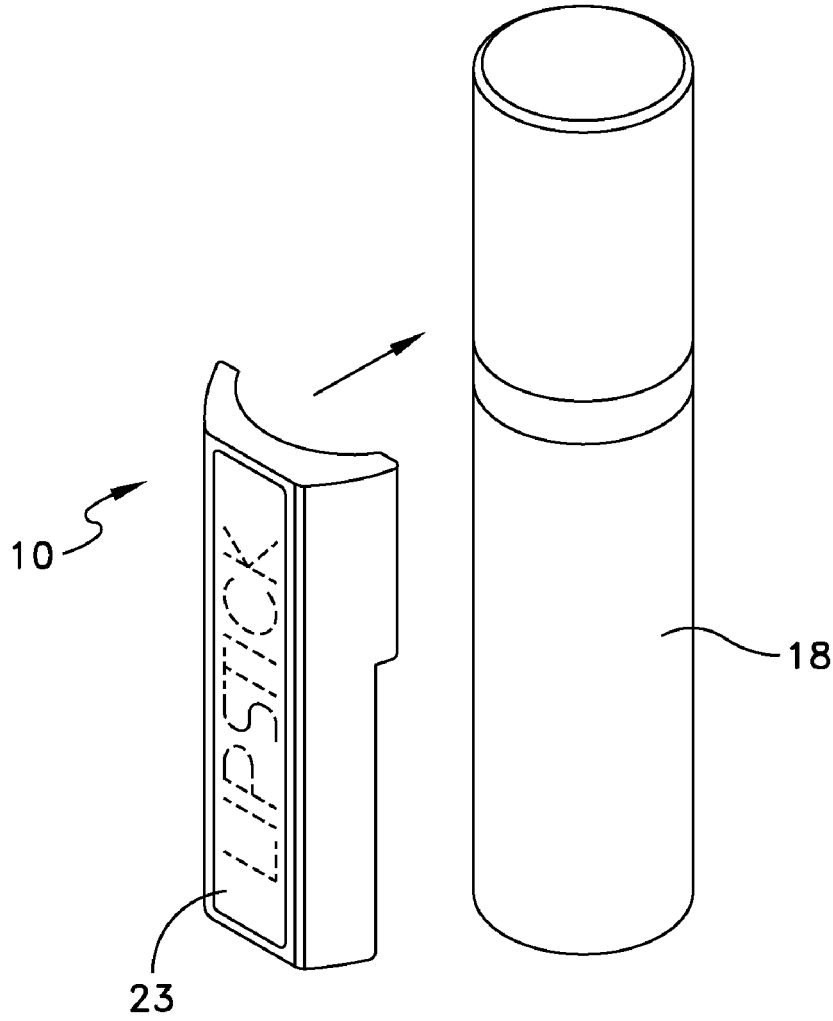
FIG. 2 is an exploded view of the anti-theft holder and cylindrical article of FIG. 1.
Figure 3:
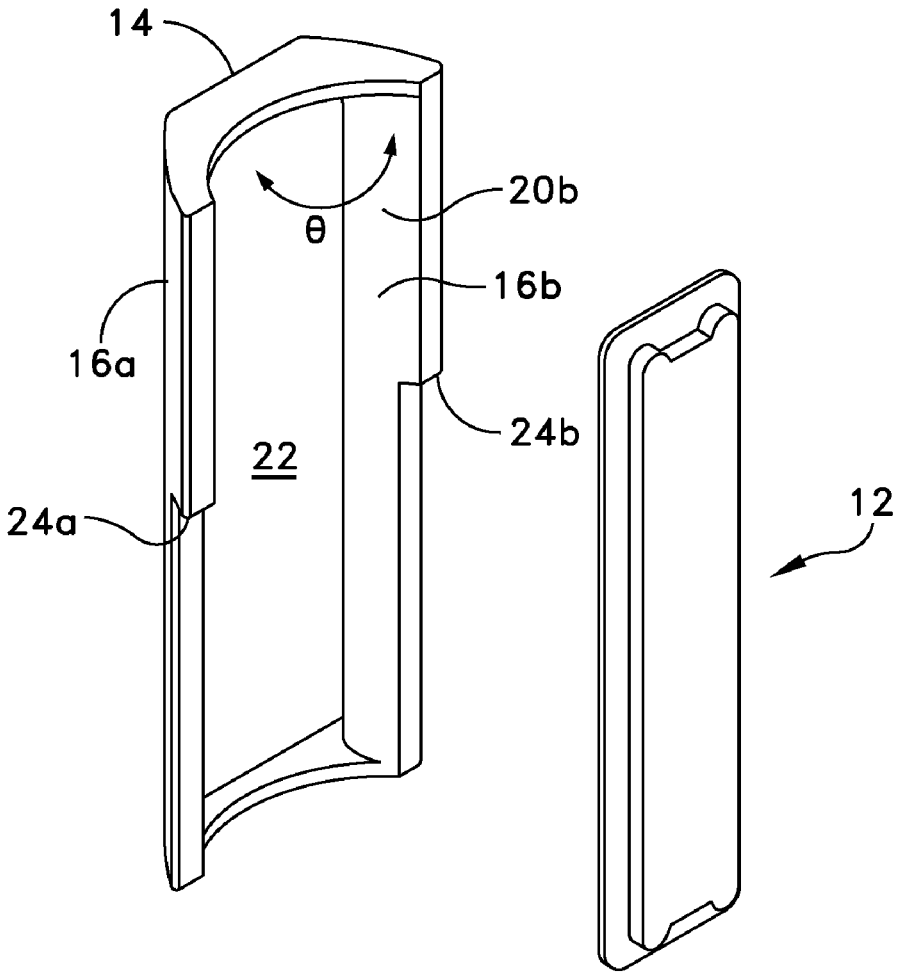
FIG. 3 is an exploded view of the anti-theft holder of FIG. 1.
Figure 4:
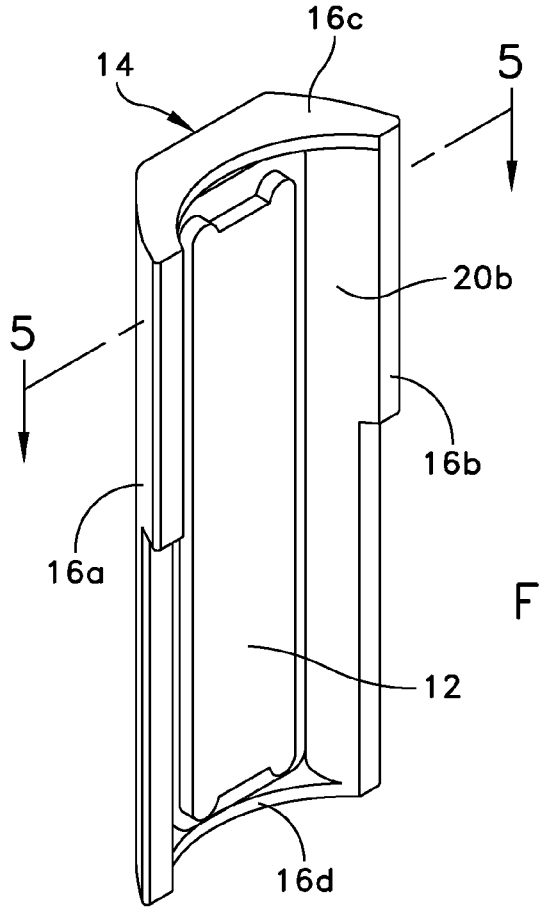
FIG. 4 is front perspective view of the anti-theft holder of FIG. 1.
Figure 5:
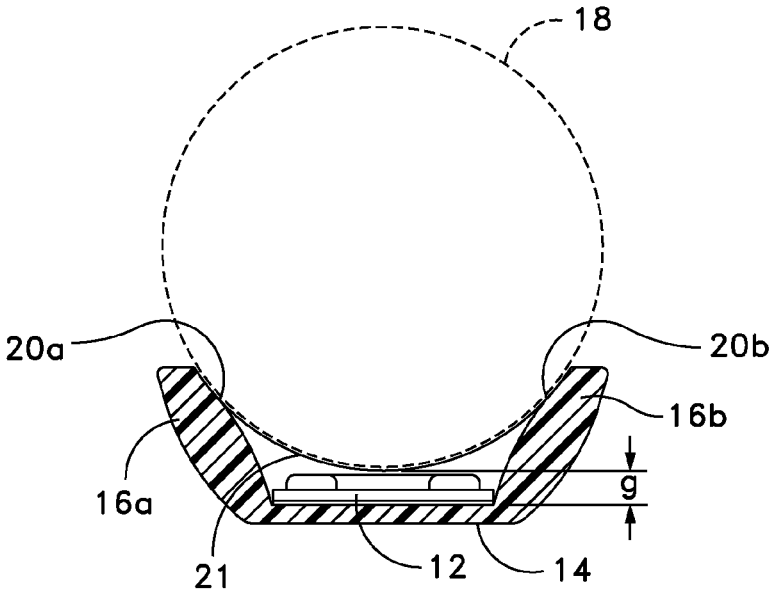
FIG. 5 is a cross-sectional view taken along lines 5-5 of FIG. 4 with the cylindrical article shown in dotted lines.

The holder 10 of the present embodiment includes a base 14 for supporting the EAS marker 12 and may further include projections or upstanding side walls 16*a*, 16*b* extending from the base 14 for supporting the cylindrical article 18. The base may be rectangular in shape, and preferably has a length sufficient to support the length of the EAS marker, as best shown in FIG. 4. In order to support the cylindrical article, in the present embodiment the side walls 16*a*, 16*b* are disposed at an angle θ with respect to the base. The angle may preferably be greater than 90° and less than 180° in order to support a portion of the circumference of the article. The angle may be varied, depending upon the outer circumference of the article being supported. In this manner, a portion of the outer circumference of the cylindrical member rests on the inner surfaces 20*a*, 20*b* of side walls 16*a*, 16*b*, respectively. In order to further support the article, the side walls may be substantially rigid and the holder may further include a pair of end walls, 16*c*, 16*d*. The first and second end walls 16*c*, 16*d* may extend between the first side wall and the second side wall, and are spaced from each other. The end walls may each further include an arcuate surface for supporting a portion of the circumference of the article. The base, side walls, and end walls may be molded as a single, unitary construction, or may be otherwise constructed, as would be known to those of skill in the art.

The side walls 16*a*, 16*b* and base 14 may also be configured with respect to each other so that a gap "g" is formed between an inner surface 22 of the base 14 and the lowermost portion 21 of the circumference of the cylindrical article when the EAS marker is not present. The gap "g" may be sized so as to fit the EAS marker 12 therein without raising the article, causing buckling or other noticeable indication of the presence of the EAS marker. In the present embodiment end walls 16*c*, 16*d* also aid in supporting the article at a distance from the base. Alternatively, the inner surface 22 of the base 14 may include a channel (not shown) for receipt of the EAS marker therein.

The side walls may further have a stepped configuration, i.e, the height of the side walls is greater at one end and is stepped down to a lower height, such that the holder has a lower profile at one end thereof which may be desirable for certain store displays. Alternatively, the side walls may have a gradual decrease in the height and no step, or need not have a decrease in height at all. The outer surface 23 of the base may include a label supported thereon including descriptive information regarding the article, for example the manufacturer's name, price, color, etc. In this manner, the use of the holder as an anti-theft device may be further concealed.

Figure 6:
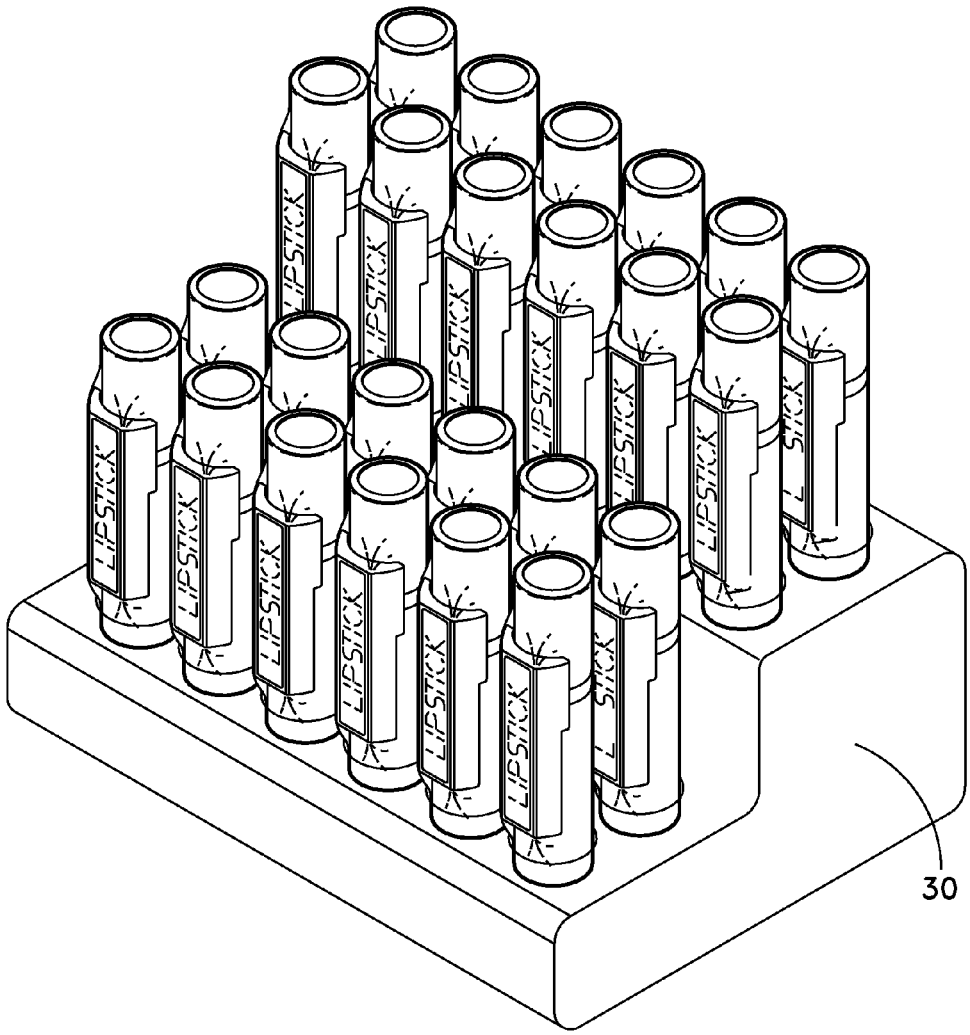
FIG. 6 is a perspective view of multiple anti-theft holders in use in a display.
Figure 7:
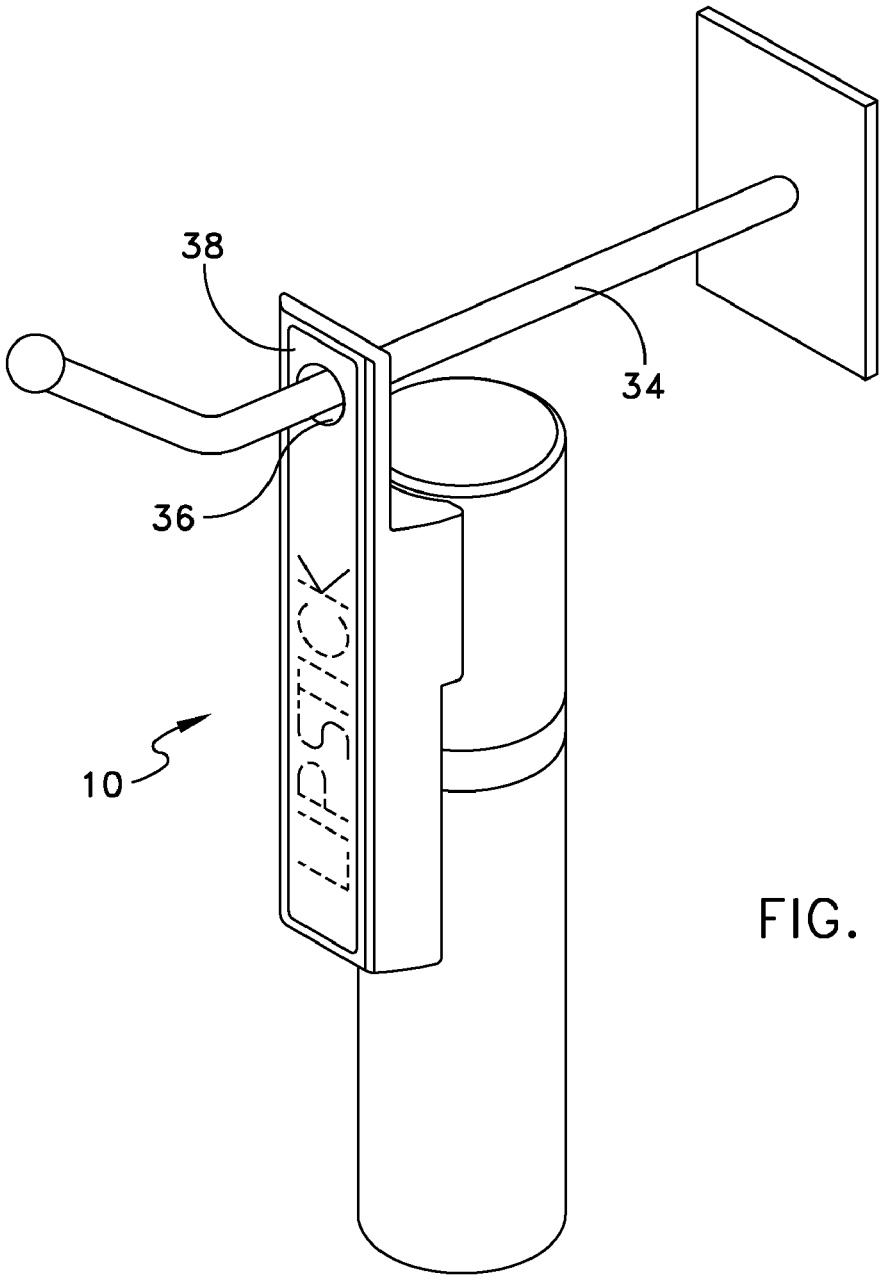
FIG. 7 is a perspective view of the anti-theft holder for a hanging display.

In order to secure the cylindrical article to the holder an outer sleeve 26 may be provided. The outer sleeve may be shrink wrapped, or otherwise applied around the base to secure the base to the article, as would be known to those of skill in the art. So that the cylindrical article is not opened by consumers, the sleeve may preferably at least extend around the article and the holder adjacent the point where the cap 18*a* of the article meets the base 18*b*. The holder of the present invention preferably has a low profile to fit within conventional store displays, such as the counter display 30 shown in FIG. 6. Alternatively, the holder 10 may be adapted for use in a hanging display 32 as illustrated in FIG. 7. For the hanging display of FIG. 7, the holder 10 includes a hanger that is supported buy a rod 34 of the display during use. In the present embodiment, the hanger includes a tab 36 including an opening 38 sized to receive the rod 34 during use. The tab 36 may be formed as a single, unitary member with the base 14, as shown, or may be formed as separate member supported by the holder. Likewise, the opening 38 may have other shapes and sizes, as would be known to one of skill in the art.

It will be understood that various modifications may be made to the embodiments disclosed herein. For example, although shown and described for use with a cylindrical object, the holder may find uses with other shapes as well, in which case there may be provided more or less walls, depending upon the particular shape, as would be known to those of skill in the art. Also, although the base is shown as rectangular it may have other shapes as well. Therefore, the above description should not be construed as limiting, but merely as exemplifications of a preferred embodiment. Those skilled in the art will envision other modifications within the scope, spirit and intent of the invention.

What is claimed is:

1. An anti-theft holder for supporting an article, comprising:

an electronic article surveillance marker;

a base sized to support the electronic article surveillance marker;

at least one side wall extending from the base at an angle of at least approximately 90 degrees with the base and less than about 180 degrees, and including an inner surface constructed and arranged to support a portion of an outer surface of the article such that a gap is formed between the article and the base; and wherein when assembled, the electronic article surveillance marker is supported by the base in the gap between the article and the base, the article being positioned in contact with the inner surface of the side walls and spaced from the base.

2. The anti-theft holder of claim 1, wherein the at least one side wall is fixed at the angle relative to the base, so as to support the article.

3. The anti-theft holder of claim 1, wherein the at least one side wall includes a pair of side walls constructed and arranged to support a portion of the outer surface of the article.

4. The anti-theft holder of claim 3, wherein the height of each of the pair of side walls decreases along a portion of each of the side walls.

5. The anti-theft holder of claim 4, wherein each of the pair of side walls has a stepped configuration.

6. The anti-theft holder of claim 3, further comprising a first end wall extending between the first side wall and the second side wall, and a second end wall spaced from the first end wall and extending between the first side wall and the second side wall.

7. The anti-theft holder of claim 1, further comprising a sleeve constructed and arranged to secure the article to the holder.

8. The anti-theft holder of claim 7, wherein the article includes at least one cylindrical surface.

9. The anti-theft holder of claim 1, further comprising a hanger constructed and arranged to receive a support member of a display.

10. The anti-theft holder of claim 9, wherein the holder includes a tab extending from the base and an opening sized to receive the support member of the display therethrough.

11. An anti-theft holder for supporting an article, comprising:

an electronic article surveillance marker;

a base sized to support the electronic article surveillance marker;

a pair of side walls extending from the base at an angle and including an inner surface constructed and arranged to support an outer surface of the article such that a gap is formed between an outer surface of the article and the base;

a first end wall supported by the base and extending between the first side wall and the second side wall, and a second end wall spaced from the first end wall and extending between the first side wall and the second side wall, the first and second end walls being constructed and arranged to support a portion of the outer surface of the article;

a sleeve constructed and arranged to secure the article to the holder; and wherein when assembled, the electronic article surveillance marker is supported in the gap between the article and the base the article being positioned in contact with the inner surface of the side walls but spaced from the base such that the marker is concealed by the holder and is not visible to a consumer.

12. The anti-theft holder of claim 11, wherein the electronic article surveillance marker is sandwiched between the base and the article.

13. The anti-theft holder of claim 11, wherein the angle is fixed relative to the base, the angle being greater than about 90 degrees and less than about 180 degrees and wherein the article is supported on the angled sidewalls during use.

14. The anti-theft holder of claim 11, wherein the article has a cylindrical portion.

15. The anti-theft holder of claim 11, wherein the height of each of the pair of side walls decreases along a portion of each of the side walls.

16. The anti-theft holder of claim 15, wherein each of the pair of side walls has a stepped configuration.

17. The anti-theft holder of claim 11, further comprising a hanger constructed and arranged to receive a support member of a display.

18. The anti-theft holder of claim 17, wherein the holder includes a tab extending from the base and an opening sized to receive the support member of the display therethrough.

19. An anti-theft holder for supporting an article, comprising:

an electronic article surveillance marker;

a base sized to support the electronic article surveillance marker;

a pair of side walls extending from the base to define a height, each side wall including an inner surface constructed and arranged to support a portion of an outer surface of the article so that article is supported a distance above the base forming a gap between the article and the base, the height of each of the pair of side walls decreasing along a portion of each of the side walls, such that the side walls have a stepped configuration; and wherein when assembled, the electronic article surveillance marker is supported by the base in the gap between the article and the base, the article being positioned in contact with the inner surface of the side walls but spaced from the base.

20. The anti-theft holder of claim 19, wherein the outer surface of the article is cylindrical.

21. The anti-theft holder of claim 19, further comprising a sleeve constructed and arranged to secure the article to the holder.

22. The anti-theft holder of claim 19, further comprising a hanger constructed and arranged to receive a support member of a display.

23. The anti-theft holder of claim 19, in combination with the article.

24. The anti-theft holder of claim 23, wherein the article is a lipstick holder.

25. The anti-theft holder of claim 23, wherein a portion of the outer surface of the article is in contact with the electronic article surveillance marker.

* * * * *